United States Patent [19]

Kennedy

[11] 4,105,895

[45] Aug. 8, 1978

[54] ELECTRIC WATER HEATER UTILIZING A HEAT PIPE

[75] Inventor: James E. Kennedy, Crofton, Md.

[73] Assignee: Electro-Therm, Inc., Laurel, Md.

[21] Appl. No.: 654,483

[22] Filed: Feb. 2, 1976

[51] Int. Cl.[2] ..... F24H 1/20; F28D 15/00; H05B 3/78

[52] U.S. Cl. ..... 219/326; 122/33; 126/361; 165/105; 219/336; 219/341; 219/439; 219/530; 219/540

[58] Field of Search ..... 122/32, 33, 40; 165/104–107; 219/530, 540, 378, 365, 325, 326, 341, 302, 316, 335, 336, 430, 439, 209; 62/3; 126/350, 360, 361

[56] References Cited

U.S. PATENT DOCUMENTS

| | | | |
|---|---|---|---|
| 1,043,922 | 11/1912 | Gold | 219/341 |
| 1,167,894 | 1/1916 | Fowler | 122/33 |
| 1,441,610 | 1/1923 | Topp | 219/326 UX |
| 1,451,880 | 4/1923 | Lightfoot | 219/315 |
| 1,960,986 | 11/1928 | Macy | 219/326 |
| 2,014,803 | 9/1935 | Hakanson | 219/325 |
| 2,237,054 | 4/1941 | Jensen | 165/105 X |
| 2,354,061 | 7/1944 | Richardson | 219/326 X |
| 2,835,480 | 5/1958 | Perez | 219/326 UX |
| 2,992,313 | 7/1961 | Taylor | 219/209 |
| 3,023,299 | 2/1962 | Mills | 219/325 |
| 3,468,300 | 9/1969 | Geyer et al. | 165/105 X |
| 3,834,171 | 9/1974 | Johansson | 62/3 |
| 3,854,454 | 12/1974 | Lazaridis | 165/105 X |
| 3,889,096 | 6/1975 | Asselman et al. | 165/105 X |
| 3,947,244 | 3/1976 | Lazaridis | 165/105 X |
| 3,965,334 | 6/1976 | Asselman et al. | 219/540 |

FOREIGN PATENT DOCUMENTS

| | | | |
|---|---|---|---|
| 681,528 | 2/1930 | France | 219/341 |
| 559,201 | 9/1932 | Fed. Rep. of Germany | 219/326 |
| 2,433,790 | 1/1976 | Fed. Rep. of Germany | 219/341 |
| 372,342 | 4/1932 | United Kingdom | 219/341 |

*Primary Examiner*—A. Bartis

*Attorney, Agent, or Firm*—Henry W. Collins; Thomas R. Vigil; Richard G. Kinney

[57] ABSTRACT

A heating device for applying heat to the interior of a closed container containing a liquid therein to be heated includes an elongate cartridge-type electric heating unit and at least one heat pipe having a heat absorbing end and a heat transmitting end. The electric heating unit is attached to the heat absorbing end of each heat pipes and the heating device is secured in an aperture in the wall of the container by means of a mounting flange. The electric heating unit is mounted in an aperture in the mounting flange and the heating unit and at least one heat pipe attached thereto extend into the interior of the chamber to apply heat to the liquid in the container.

11 Claims, 7 Drawing Figures

ELECTRIC WATER HEATER UTILIZING A HEAT PIPE

BACKGROUND OF THE INVENTION

This invention relates generally to improvements in heating devices, and more particularly, to a heating device utilizing a cartridge-type electric heating unit and a heat transfer member, such as a heat pipe, for heating a liquid in a chamber or storage container.

One presently available widely used electric hot water heater includes a hot water tank and one or two electric heating elements mounted in the wall of the tank. Typically, the heating element is of the so-called hairpin type including a mounting flange and a copper sheathed U-shaped heating element. The element itself is a helical resistance coil which is located within and electrically insulated from a tubular copper sheath. The ends of the tubular sheath are fixed in a mounting flange which is adapted to be secured in a fluid-tight manner to a wall of the tank about an opening in the tank wall with the sheathed heating element disposed within the tank. Electric power is supplied to the heating element through terminals extending outwardly of the flange from insulated ends of the sheathed element.

Such heating elements are constructed with different power, i.e., wattage, ratings, to meet different heating requirements. Also, it is common practice to supply at least four different watt densities (i.e., watt/sq. in. of copper sheath area) for each wattage. Watt density is the main factor which determines the life expectancy and cost of a conventional heating element. High watt density elements (175–300 W/in.$^2$) offer economy in cost, but are prone to build up mineral deposits or scales from the water and high internal operating temperatures, as a result of which such elements are more prone to failure and have a short life expectancy. On the other hand, low watt density elements (40–80 W/in.$^2$) have a longer life expectancy, but are more costly. Both types of elements plus elements having intermediate watt densities are commonly used.

An electric heating element which is, in some cases, more economical than the hairpin type is the so-called cartridge-type heating element. However, a cartridge-type heating element with the same wattage/watt density ratio as a hairpin-type heating element is rather large. In other words, to achieve the necessary sheath area in a tank of small diameter, it is necessary to use large diameter cartridge heating elements (1 inch or more). With such large diameters, the operating temperatures within the element become excessive and shorten the life of the element. As a result, cartridge-type heating elements are not in widespread use in presently available domestic electric hot water heaters.

As will be described more fully hereinafter, the present invention provides an economical heating device which utilizes cartridge-type heating elements. Also, as more fully described hereinafter, this is achieved by utilizing a heat pipe in the heating device.

Heretofore, it has been proposed to utilize a heat pipe in a fossil fuel fired hot water heater as disclosed in U.S. Pat. No. 3,854,454. As will be readily apparent from the following description, the present invention differs in several respects from the heat pipe hot water heater disclosed in this patent. In particular, and as more fully described hereinafter, the present invention has a novel construction utilizing an electric cartridge heating element and one or more heat pipes and provides an improvement over presently available electric hot water heaters and heaters used in hemodialysis equipment

SUMMARY OF THE INVENTION

According to the invention there is provided a heating device for applying heat to the interior of a substantially closed container containing a liquid therein to be heated, comprising a separate, elongate, cartridge-type electric heating unit, separate, elongate heat transfer means for transferring heat between the ends thereof, said heat transfer means having a heat absorbing end and a heat transmitting end and having high conductivity with a low temperature differential between the ends thereof, means for attaching said heating unit adjacent said heat absorbing end of said heat transfer means, and means for securing said heating device in a fluid-tight manner in a wall of a container with said heat transmitting end of said heat transfer means positioned within the container to apply heat to a liquid in the container, said securing means including a mounting flange having an aperture therein for receiving said cartridge-type electric heating unit, means for holding said heating unit in a fluid-tight manner in said aperture and means for fastening said flange in a fluid-tight manner to the wall of the container about an opening therein.

Also according to the invention there is provided a heater assembly comprising: a substantially closed chamber for receiving a liquid to be heated therein, a separate, elongate, cartridge-type electric heating unit, separate, elongate heat transfer means for transferring heat between the ends thereof, said heat transfer means having a heat absorbing end and a heat transmitting end and having high conductivity with a low temperature differential between the ends thereof, means for attaching said heating unit adjacent said heat absorbing end of said heat transfer means, and means for mounting said heat transmitting end of said heat transfer means within said chamber to apply heat to a liquid in said chamber, said mounting means including a flange having an aperture therein for receiving said cartridge-type electric heating unit, means for holding said heating unit in a fluid-tight manner in said aperture and means for mounting said flange in a fluid-tight manner to a wall of said chamber about an opening therein.

DESCRIPTION OF THE PREFERRED EMBODIMENTS

Figure 1:
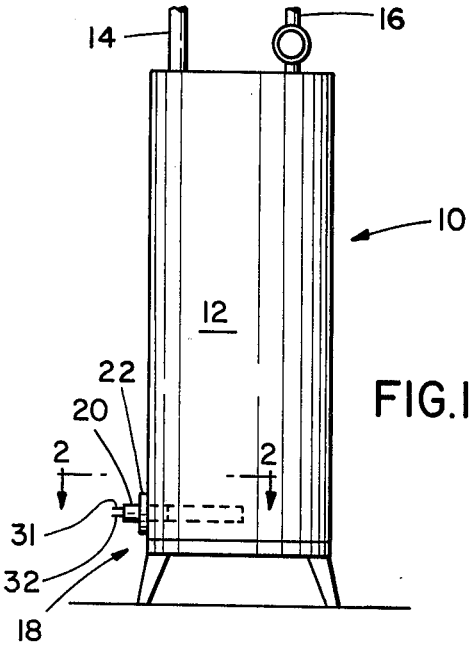
FIG. 1 is an elevational view of a hot water heater utilizing a heating device which is mounted in a wall thereof and which is constructed in accordance with the teachings of the present invention.

Referring now to the drawings in greater detail, an electric hot water heater is shown in FIG. 1 and is generally identified by the reference numeral 10. The hot water heater 10 includes a hot water tank 12 connected to an inlet pipe 14 and an outlet pipe 16 at the top thereof and a heating device 18 which is mounted in an opening in a side wall of the tank 12 and which is constructed in accordance with the teachings of the present invention.

Figure 3:
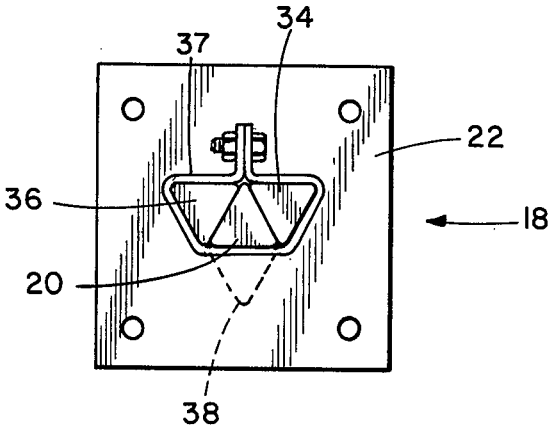
FIG. 3 is an end view of the heating device shown in FIG. 2 and is taken along line 3—3 of FIG. 2 omitting the heater wall.
Figure 2:
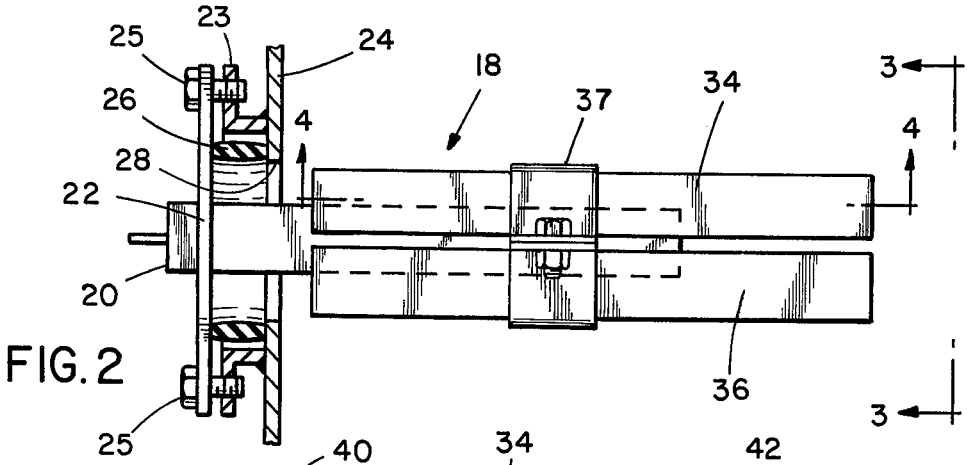
FIG. 2 is a top view of the heating device shown in FIG. 1 showing only a portion of the heater wall and is taken along line 2—2 of FIG. 1.
Figure 4:
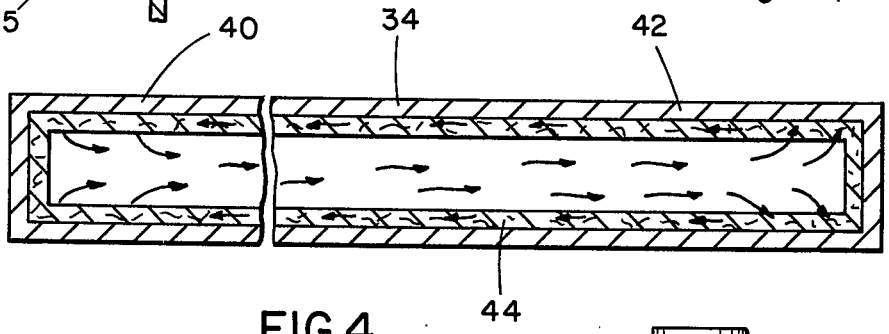
FIG. 4 is a sectional view of a heat pipe utilized in the heating device shown in FIGS. 1 to 3 and is taken along line 4—4 of FIG. 2.

The details of construction of the heating device 18 are best shown in FIGS. 2–4. More specifically, as shown in FIG. 2, the heating device 18 includes an elongate, cartridge-type electric heating element or unit 20 mounted in a fluid-tight manner in an aperture in a mounting flange 22. The flange 22 is secured to a tank adapter 23 fixed to a side wall 24 of the tnak 12 by bolts 25. A sealing gasket tank is located between the flange 22 and the wall 24 and held in place by the bolts 25. As shown, the flange 22 is mounted to the wall 24 about an opening 28 in the wall 24 into which the body of the cartridge heating unit 20 extends.

At the outer or exterior end of the cartridge heating unit 20 are two terminals 31 and 32 (FIG. 1) for connecting the heating unit 20 to a suitable source of electric power, such as a 120 volt 60 Hz source.

The heating device 18 further includes one, two, or three elongate heat pipes. In FIG's. 2 and 3 two heat pipes 34, 35 are shown fixed to the heating unit 20, such as by brazing or soldering. It is to be understood, of course, that other means, such as a bracket 37 in FIGS. 2 and 3, can be utilized for fixing the heat pipes 34 and 36 to the heating unit 20. As best shown in FIG. 3, the heating unit 20 and the heat pipes 34 and 36 have, in the illustrated embodiment, a triangular cross section. In this way, the heat pipes 34 and 36 each can be disposed and fixed along one flat side of the cartridge heating unit 20. With the heating unit 20 having three elongate sides, there is one free side to which a third heat pipe 38 can be fixed, if desired, as shown in phantom lines in FIG. 3.

The heat pipes 34 and 36 form a heat transfer means. Since these heat pipes 34 and 36 are identical only the construction of the heat pipe 34 will be described in detail with reference to FIG. 4, it being understood that the other heat pipes 36 and 38 have the same construction. As shown in FIG. 4, the heat pipe 34 has a heat absorbing end 40 and a heat transmitting end 42. The interior of the heat pipe 34 is hollow and has a working fluid therein. Each of the heat pipes 34, 36 and 38 is a closed cycle, two-phase system with rapid heat transfer being obtained by evaporating the working fluid at the heat absorbing end 40 of the heat pipe, collecting the hot vapor at the heat transmitting end 42 of the heat pipe and condensing the hot vapor to recover the latent heat of vaporization which is transmitted from the heat transmitting end 42 to a medium to be heated, such as water in the water tank 12. The cycle is completed by returning the condensate of the working fluid to the heat absorbing or evaporating end by capillary action, typically with a wick material 44 lining the inside of the pipe 34 or by gravity with or without a wick. The most outstanding characteristic of a heat pipe is the very small temperature difference between the ends thereof. In other words, there is a low temperature gradient along the entire length of the heat pipe 34, such that it has an apparent thermal conductivity far higher than solid copper or solid silver.

From the foregoing description it is apparent that the heating device 18 comprises the combination of two elongate heat pipes 34 and 36 forming a heat transfer means and one elongate cartridge-type electric heating unit 20 fixed to the heat absorbing ends 40 of the heat pipes 34 and 36. With this construction the heating unit 20 can have any one of several wattages which can be easily adapted to any watt density for the heating device 18 merely by changing the size or number of heat pipes utilized in the device 18. In this way a cartridge heating unit can be manufactured having the highest usable watt density, e.g., 200 W/in.$^2$. This cartridge heating unit then can be quickly converted to any other lower watt density by attaching one or more heat pipes of different size thereto. This construction and arrangement has the significant advantage that a basic model of the heating unit 20 can be fabricated for each wattage and all desired watt densities made available by attaching a heat pipe or pipes thereto. Another advantage is that the heating device 18 makes it possible, practical and economical to use cartridge-type electric heating units in domestic water heaters, which heating units have inherent economies of construction and manufacture.

Figure 5:
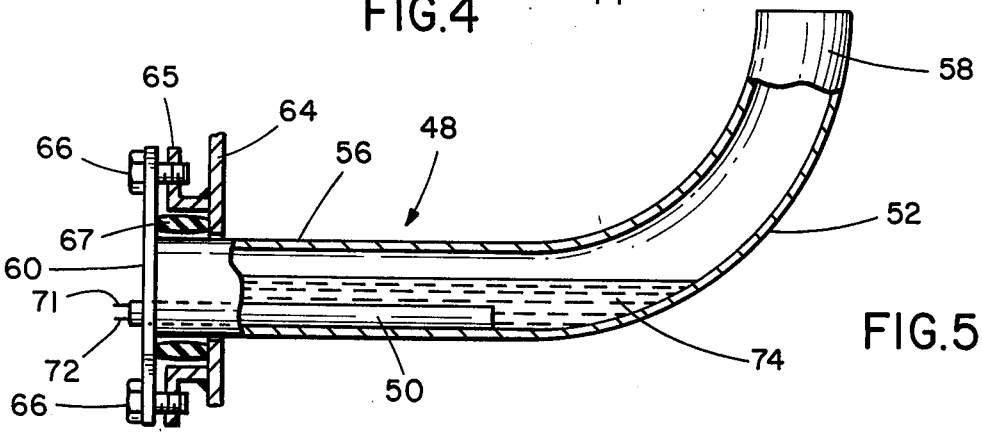
FIG. 5 is a side elevational view partially in section of another embodiment of a heating device constructed in accordance with the teachings of the present invention.

Another embodiment of a heating device constructed in accordance with the teachings of the present invention is illustrated in FIG. 5 and is generally identified by reference numeral 48. The heating device 48 includes a cartridge heating unit 50 which is situated within a heat pipe 52. The heat pipe 52 has a heat absorbing end 56 and a heat transmitting end 58 and is bent or curved upwardly from the heat absorbing end 56 to the heat transmitting end 58. The heat absorbing end 56 is fixed to a flange 60 for mounting the heating device 48 to a wall 64 of a chamber, e.g., in a water heater or hemodialysis equipment. The flange 60 is fastened by bolts 65 to a tank adapter 66 fixed to the wall 64. A gasket 67 is disposed between the flange 60 and the wall 64 and around an opening 68 in the wall 64 through which the heat pipe 52 extends into the chamber. One end of the cartridge heating unit 50 is situated exteriorly of the chamber wall 64 and the flange 60 and has two terminals 71, 72 for connecting the heating unit 50 to a suitable source of electric power.

In this embodiment a wick is not utilized. Instead a working liquid is provided in the heat pipe 52 and collects in a pool 74 at the lower heat absorbing end 56 of the heat pipe 52. The heating unit 50 extends into the pool 74 as shown, so that when the heating device 48 is in use, working liquid is vaporized by the heating unit 60, the vapor rises to the heat transmitting end 58 where it condenses and the condensed liquid drains downwardly by gravity along the interior surfaces of the heat pipe 52 back into the pool 74.

This embodiment has the readily apparent advantage of a considerable savings in materials. In this respect, instead of having a large diameter cartridge heating unit which is filled with a large quantity of insulation material and resistance wire, a small cartridge heating unit 50 is utilized which is enclosed in a tubular heat pipe partially filled with water only.

Figure 6:
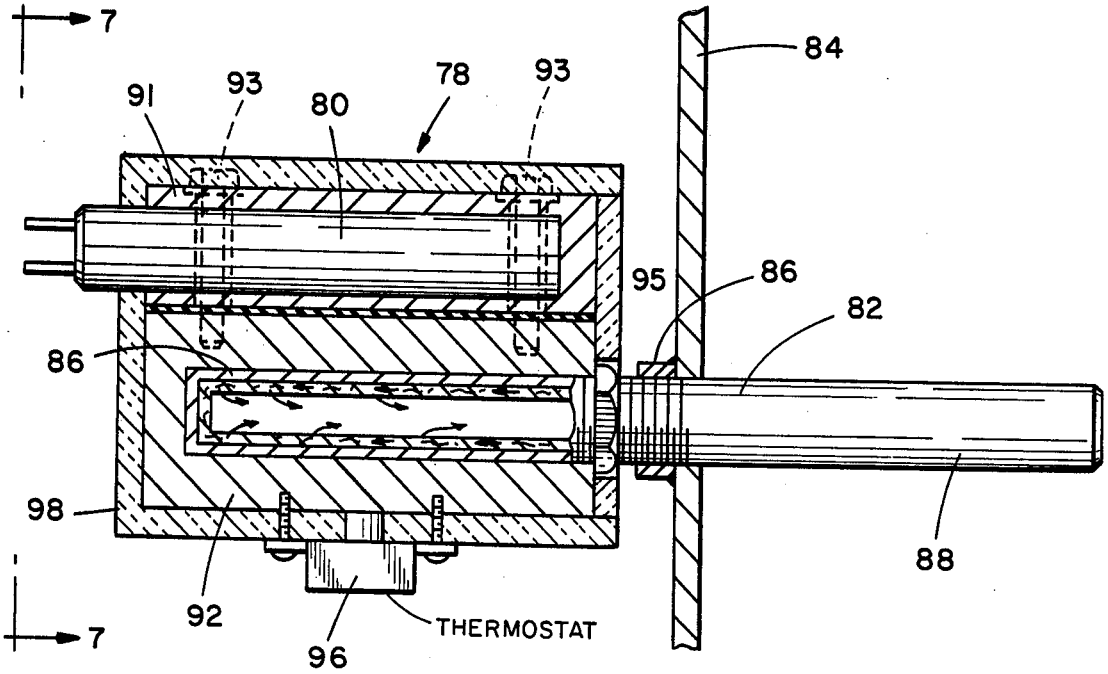
FIG. 6 is a side elevational view partially in section of still another embodiment of a heating device constructed in accordance with the teachings of the present invention and utilized in a hemodialysis device.
Figure 7:
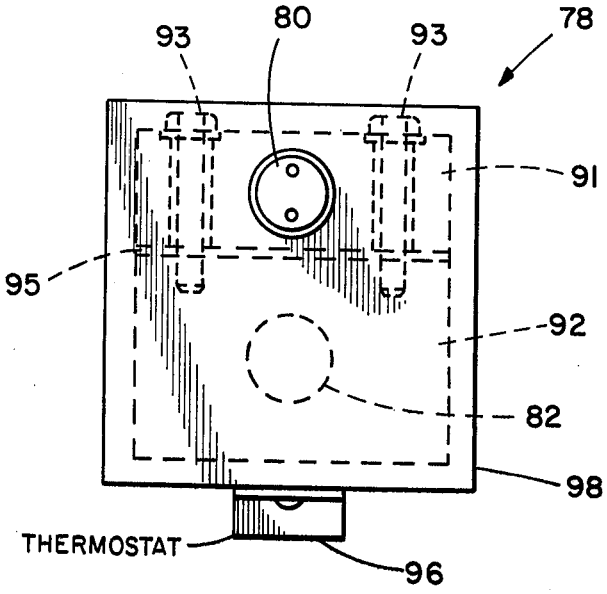
FIG. 7 is an end view of the heating device shown in FIG. 6 and is taken along line 7—7 of FIG. 6.

Still another embodiment of a heating device constructed in accordance with the teachings of the present invention is shown in FIGS. 6 and 7 and is generally identified by the reference numeral 78. Here, the heating device 78 includes a cylindrical cartridge heating unit 80 and a heat pipe 82 which is threadably mounted in a wall 84 of a chamber in a hemodialysis device. A lock nut 86 is used to lock the heat pipe 82 to the wall 84 with a heat absorbing end 86 of the heat pipe 82 positioned exteriorly of the chamber and a heat transmitting end 88 of the heat pipe 82 positioned within the chamber to apply heat to a fluid medium therein. In this embodiment the heat absorbing end 86 of the heat pipe 82 is fixed to and thermally coupled to the cartridge heating unit 80 exteriorly of the chamber. This is accomplished by placing or fitting the heating unit 80 in a first aluminum block 91 and the heat absorbing end 86 of heat pipe 82 in a second aluminum block 92 and then fastening the blocks 91 and 92 together with fasteners 93 each of which is insulated by a sleeve and a washer from block 91 as shown in FIGS. 6 and 7. In order to minimize, if not prevent, leakage of electrical current from the heating element in the heating unit 80, a thin layer of insulating material 95, such as a thin piece of mica, is placed between the blocks 91 and 92.

With this arrangement a "double insulation" is provided. In this respect, a typical heating unit 80 includes electrical insulation surrounding an electric resistance wire inside a sheathed tube which allows only small leakage currents, typically less than 100 microamps. The insulating layer 95 between the blocks 91 and 92 effectively eliminates such leakage currents normally incurred with cartridge-type heating units. Of course, the thickness of the insulating layer 95 is chosen to provide good electrical insulation without creating a large temperature gradient.

The "double insulation" is desirable for safety reasons. For example, grounding, which eliminates all danger of electrical shock, is not always done in the field when heating devices are installed. When it is not done, leakage currents can be conducted to ground through any conductive path, including humans. More specifically, in the illustrated embodiment if the heater assembly of the hemodialysis device including the heating device 78 is not grounded, current could flow through the liquid being heated to the person connected to the hemodialysis device, who, if in contact with earth (via a water pipe, cement floor, etc.) will transmit the current to ground. Again, the construction of the heating device 78 eliminates this danger.

The heating device 78 further includes a thermostat 96 mounted to the block 92 and a thermal insulation jacket 98, typically made of fiberglass, surrounding the blocks 91 and 92 to prevent loss of heat to the ambient environment.

The use of the blocks 91 and 92 facilitates the inclusion of the thermostat 96 in the heating device 78 and, more specifically, the use of an inexpensive bimetallic thermostat. In this way if the heat transmitting end 88 of the heat pipe 82 becomes heavily coated with mineral deposits from the water or liquid it is heating, or if the heating device 78 is energized while the heat pipe 82 is not immersed in water, the bimetallic thermostat will sense the resultant high temperature on the block 92 and de-energize the heating device 78.

From the foregoing description it is readily apparent that the heating device of the present invention has numerous advantages, some of which have been described above and others of which are inherent in the invention. Also from the various embodiments described above, it is apparent that obvious modifications and variations can be made to the heating device without departing from the spirit or scope of the invention. Accordingly, the invention is only to be limited as necessitated by the accompanying claims.

I claim:

1. A heating device for applying heat to the interior of a substantially closed container containing a liquid therein to be heated, comprising a separate, elongate, cartridge-type electric heating unit, separate, elongate heat transfer means for transferring heat between the ends thereof, said heat transfer means having a heat absorbing end and a heat transmitting end and having high conductivity with a low temperature differential between the ends thereof, means for attaching said heating unit adjacent said heat absorbing end of said heat transfer means, and means for securing said heating device in a fluid-tight manner in a wall of a container with said heat transmitting end of said heat transfer means positioned within the container to apply heat to a liquid in the container, said securing means including a mounting flange having an aperture therein for receiving said cartridge-type electric heating unit, means for holding said heating unit in a fluid-tight manner in said aperture and means for fastening said flange in a fluid-tight manner to the wall of the container about an opening therein.

2. The heater device according to claim 1, wherein said heat transfer means includes at least two heat pipes fixed to said heating unit in positions so as to be completely within the container when said heating device is secured to the wall of the container.

3. The heating device according to claim 1, wherein said heat transfer means comprises at least one heat pipe having a working fluid therein, said working fluid being evaporated at said heat absorbing end and condensed at said heat transmitting end, and means within said heat pipe for returning the condensed working fluid at said heat transmitting end back to said heat absorbing end where said working fluid is again evaporated.

4. The heating device according to claim 1 wherein said attaching means includes metallic bond between said heating unit and said heat absorbing end of said heat transfer means.

5. The heating device according to claim 1 wherein said attaching means includes a bracket for holding said heating unit to said heat absorbing end of said heat transfer means.

6. A heater assembly comprising: a substantially closed chamber for receiving a liquid to be heated therein, a separate, elongate, cartridge-type electric heating unit, separate, elongate heat transfer means for transferring heat between the ends thereof, said heat transfer means having a heat absorbing end and a heat transmitting end and having high conductivity with a low temperature differential between the ends thereof, means for attaching said heating unit adjacent said heat absorbing end of said heat transfer means, and means for mounting said heat transmitting end of said heat transfer means within said chamber to apply heat to a liquid in said chamber, said mounting means including a flange having an aperture therein for receiving said cartridge-type electric heating unit, means for holding said heating unit in a fluid-tight manner in said aperture and means for mounting said flange in a fluid-tight manner to a wall of said chamber about an opening therein.

7. The heater assembly according to claim 6, wherein said heat transfer means comprises at least one heat pipe having a working fluid therein, said working fluid being evaporated at said heat absorbing end and condensed at said heat transmitting end, and means within said heat pipe for returning the condensed working fluid at said heat transmitting end back to said heat absorbing end where said working fluid is again evaporated.

8. The heater assembly according to claim 6, being a hot water heater and wherein said chamber is a hot water tank.

9. The heater assembly according to claim 6, being a part of a hemodialysis device and wherein said chamber is a component thereof.

10. The heater assembly according to claim 6 wherein said attaching means includes metallic bond between said heating unit and said heat absorbing end of said heat transfer means.

11. The heater assembly according to claim 6 wherein said attaching means includes a bracket for holding said heating unit to said heat absorbing end of said heat transfer means.

* * * * *